United States Patent [19]

Lin

[11] Patent Number: 4,987,640

[45] Date of Patent: Jan. 29, 1991

[54] SUPER-THIN HINGE WITH RESILIENTLY BIASED CATCH

[75] Inventor: Tsong-Chi Lin, Kaohsiung Hsien, Taiwan

[73] Assignee: Hu Lin Industrial Co., Ltd., Taiwan

[21] Appl. No.: 318,020

[22] Filed: Mar. 2, 1989

[51] Int. Cl.[5] ..... E05D 11/10

[52] U.S. Cl. ..... 16/327; 16/332

[58] Field of Search ..... 16/327, 321, 278, 332, 16/337, 342

[56] References Cited

U.S. PATENT DOCUMENTS 4,368,558 1/1983 Grass ..... 16/332
4,506,409 3/1985 Lautenschlager ..... 16/DIG. 43

FOREIGN PATENT DOCUMENTS 2457398 6/1976 Fed. Rep. of Germany ..... 16/332

*Primary Examiner*—Richard K. Seidel
*Assistant Examiner*—Carmine Cuda
*Attorney, Agent, or Firm*—Larson and Taylor

[57] ABSTRACT

A super-thin hinge with a resiliently biased catch capable of opening 120 degrees to be used on a thin walled door of an article of furniture.

2 Claims, 4 Drawing Sheets

"PRIOR ART"

SUPER-THIN HINGE WITH RESILIENTLY BIASED CATCH

BACKGROUND OF THE INVENTION

Hinges for the doors of articles of furniture generally have different structures according to the angles the doors are opened for. This inventor filed an American application called "A base for setting a hinge", which got the application number 07/197,168. That is applied to hinges possible to open for 180 degrees. A hinge used for opening a door for 120 degrees is shown in FIG. 1. It comprises a bowl A to be fixed on a door of an article of furniture, a mounting plate B to be fixed firmly on the side wall of the article and combined with a hinge arm D by means of a screw C, said hinge arm D together with a shaft E of plastics firmly fixed with the bowl A by means of a pin F, a plate G covering the bottom of the bowl and containing two springs to push to sliding blocks H so that said two blocks can push against the shaft E to limit the shaft E to turn and to be kept stopped at any angle within 0 to 120 degrees. This kind of hinge has to have strong components to cope with frequent opening and shutting movement of a door, and in addition, to have such a thinness as can be to facilitate its setting on an article. So it is generally made about 15 mm thick, and this size could hardly have been changed to a smaller one so far. Besides, the springs are compressed in a short distance so that their setting needs a high technique, and the plate G is directly hooked with the bowl A by means of hooks so that the plate G is liable to loosen off the bowl A because of long use and to fall down elastically pushed by the springs. If so, this hinge may become useless.

SUMMARY OF THE INVENTION

The object of this invention is to provide a super-thin hinge with an improved structure, wherein its thickness has been reduced to about 12 mm, its structure made stronger and its manufacture more convenient as well.

This super-thin hinge according to the present invention comprises a bowl to be fixed on a door of an article of furniture, a mounting plate to be fixed on a side wall of the article of furniture, a hinge arm to be combined with the mounting plate, a shaft to be combined with the hinge arm and with the bowl by means of a pin, two springs each pushing a sliding block, and a plate covering the bowl.

The bowl is provided with two separate openings separated by four walls for receiving respectively the springs and the sliding blocks, and one end of the openings is closed for the spring to push and the other is open for the sliding block to extend out to push the shaft. The bowl is also provided with two pin holes for a pin to insert through in combining itself with the shaft together with the hinge arm so that the bowl can swing for 120 degrees pivotally with the pin as a pivot. After the springs and the sliding blocks have been set in the openings of the bowl, a plate is attached by riveting to cover the bowl to prevent the springs and the sliding blocks from falling off.

The mounting plate is to be fixed firmly and immovably on a side wall of an article of furniture by means of any proper method, and is provided with a threaded hole for combining itself with the hinge arm as one unit with a screw.

BRIEF DESCRIPTION OF THE DRAWINGS

This invention will now be described in detail with reference to accompanying drawings wherein.

DETAILED DESCRIPTION OF THE INVENTION

Figure 1:
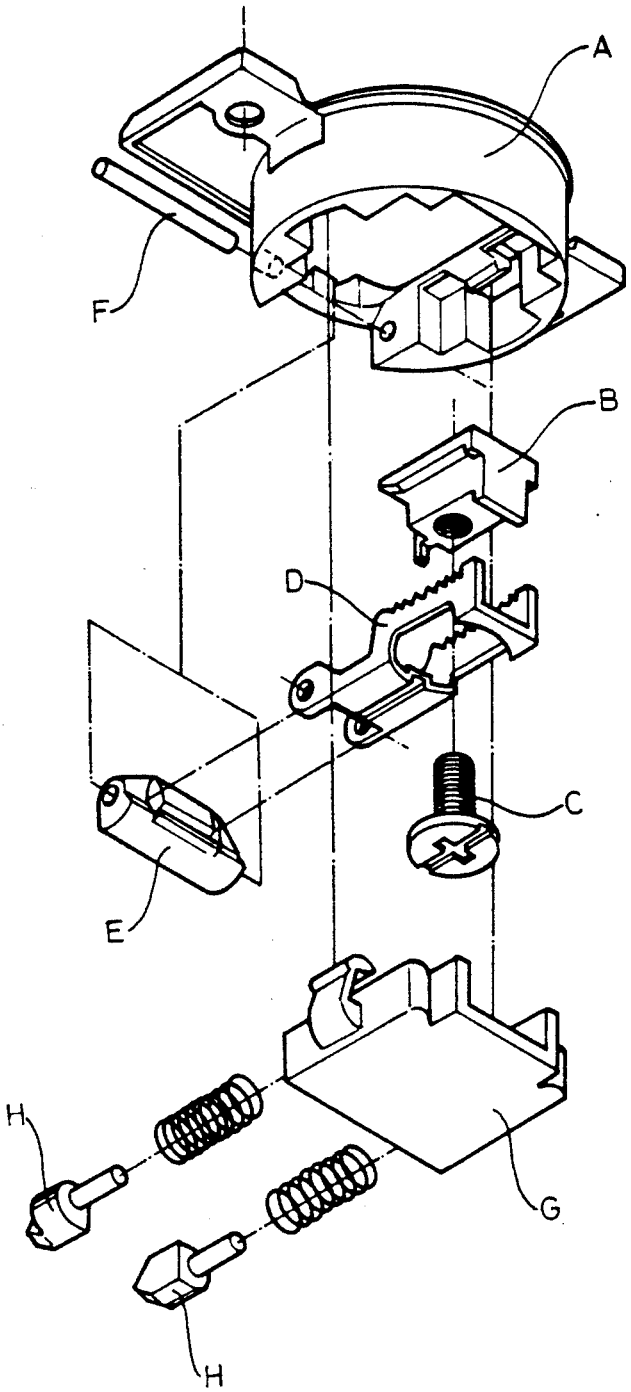
FIG. 1 is an exploded perspective view of a conventional hinge.
Figure 2:
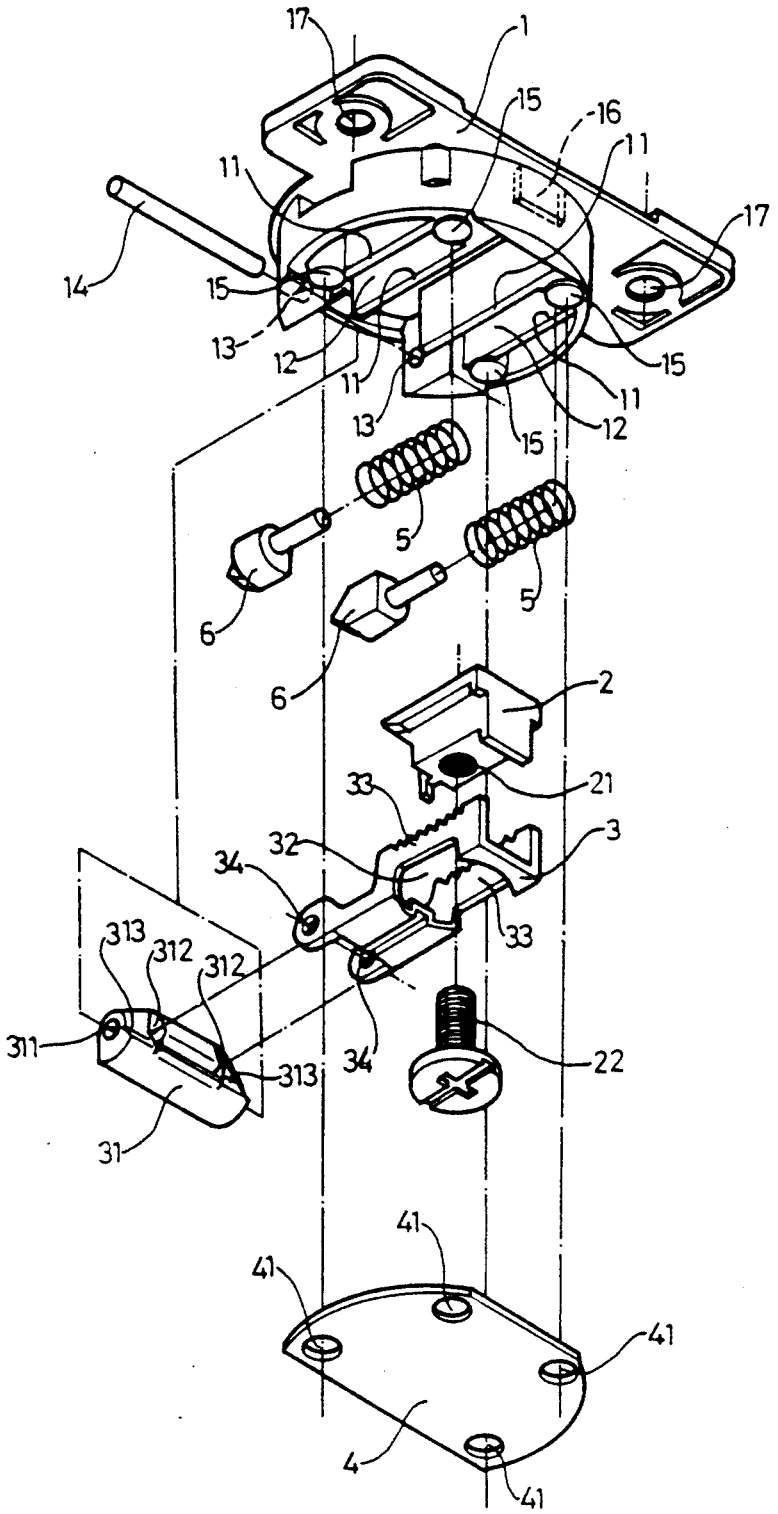
FIG. 2 is an exploded perspective view of the super-thin hinge with an improved structure in accordance with the presence invention.

This super-thin hinge with an improved structure in accordance with the present invention, as shown in FIG. 2, comprises a metal bowl 1 far thinner than that of a conventional hinge shown in FIG. 1. The bowl 1 is provided with four vertical walls 11 forming two openings 12 for receiving a spring 5 and a sliding block 6 respectively. The openings 12 have one end closed and the other end open for the sliding blocks 6 pushed by the springs 5 to extend out thereof. The bowl 1 is also provided with pin holes 13 for a pin 14 to insert therein to combine a hinge arm 3 and a shaft 31 with the bowl 1, and four protruding post heads 15 to rivet a plate 4 firmly after the plate 4 is placed to cover the bottom of the bowl 1. Besides, a recess 16 is provided in the inner face of the bowl 1 for a mounting plate 2 to stop therein when it is pushed inward. And two apertures 17 are provided at both ends of the bowl 1 for setting the bowl 1 on a door of an article of furniture. The post heads 15 are firmly set therein by means of riveting.

The mounting plate 2 is set firmly on a side wall of the article of furniture by means of any proper method, and is provided with a threaded hole 21 for linking a hinge arm 3 with the mounting plate 2 with a screw 22. (FIG. 2 shows that the mounting plate 2 is drawn under the bowl 1 in order to illustrate it to combine wih the hinge arm 3 but practically it is on the base 1). The mounting plate 2 is ordinarily positioned in the bowl 1 after combined with the hinge arm 3, and stops in the recess 16 in the circular circumference of the bowl 1. The screw 22 has a large head which can stick at a wall 33 of the hinge arm 3 to combine the mounting plate 2 with the hinge arm 3 as one unit.

The hinge arm 3 is provided with two pin holes 34 separately facing exactly against the pin hole 311 of a shaft 31 for a pin 14 to pass through so that the hinge arm 3 together with the shaft 31 may be combined with the bowl 1 with the pin 14 also inserting in the pin holes 13 of the bowl 1. The shaft 31 is provided with two grooves 312 for the hinge arm 3 to stick in, and a recess 313 separately at the outside of each groove 312 for the sliding blocks 6 to position therein at zero degree when it comes there.

The plate 4 covers the bowl 1 after the related parts are set therein, and is provided with holes 41 to correspond with the post heads 15 of the bowl 1, and the post heads 15 are firmly set therein by means of riveting.

Figure 3:
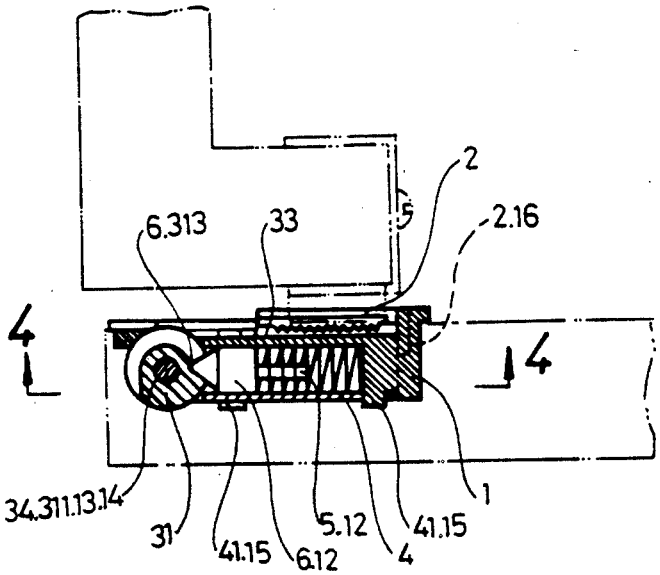
FIG. 3 is a cross sectional view taken along line 3—3 of FIG. 4.
Figure 4:
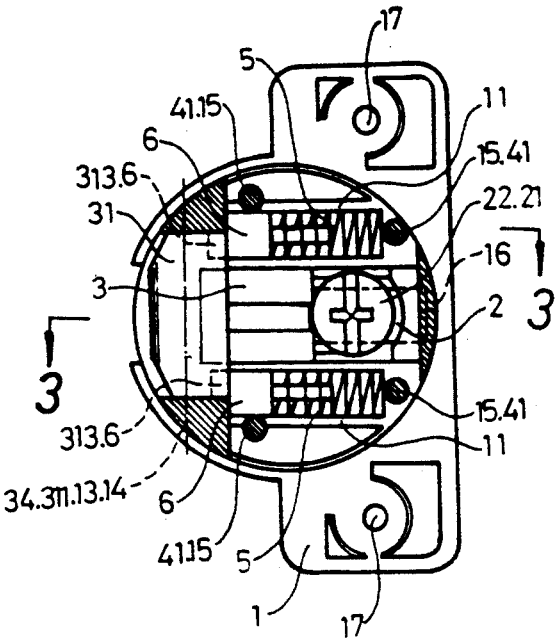
FIG. 4 is a cross sectional view taken along line 4—4 of FIG. 3.

Next, FIGS. 3 and 4 show this hinge is in the position of zero degree angle, and the springs 5 are stretched to push the sliding blocks 6 to stick in the recesses 313 so that the door cannot be opened automatically.

Figure 5:
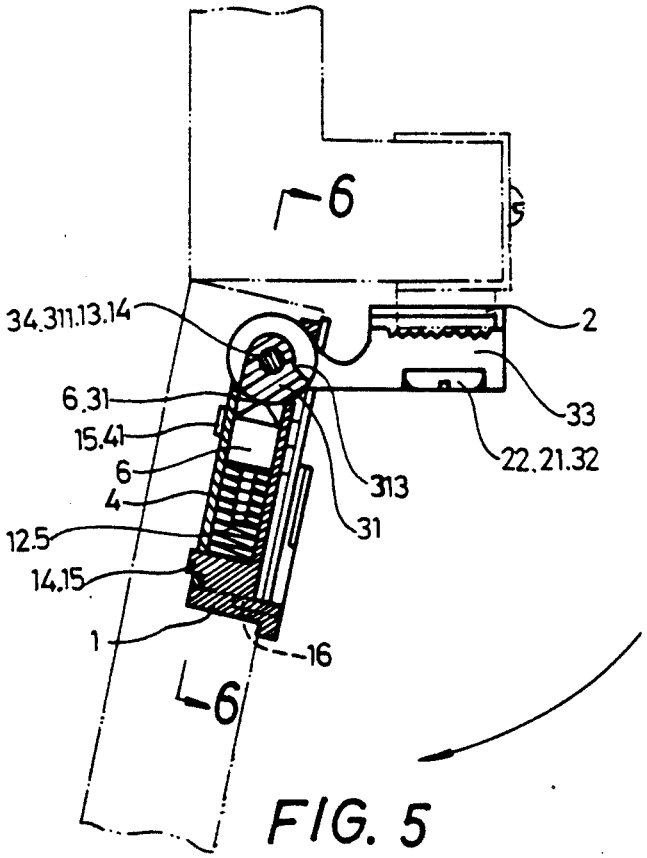
FIG. 5 is a cross sectional view taken along line 5—5 of FIG. 6.
Figure 6:
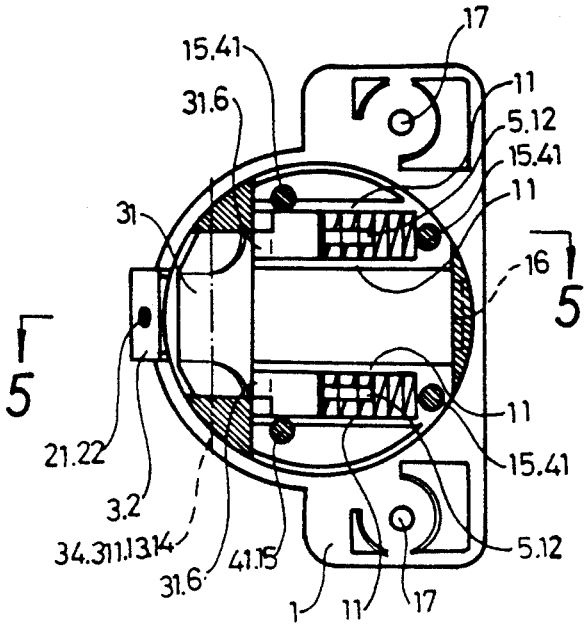
FIG. 6 is a cross-sectional view taken along line 6—6 of FIG. 5.

Next, FIGS. 5 and 6 show this hinge is in the position opened for 120 degrees angle, and the springs 5 are compresed, but can still push the sliding blocks 6 to extend out sticking at any place on the shaft 31 so that the door can be opened to any angle and be kept stopped at that angle.

As this hinge has the structure that the sliding blocks 6 are directly sunk in the openings 12, it is convenient for manufacturing. Besides, the springs 5 can never fall off as they are closed in the bowl 1 covered by the riveted plate 4. It is quite suitable for a thin article of furniture because of its thinness.

What is claimed is:

1. A thin hinge comprising:

a metal bowl having (a) a base, (b) an upstanding side extending from said base and having an opened portion bounded by terminal ends of said upstanding side, and (c) two pairs of discrete upstanding retaining walls extending from said base, said retaining walls of each said pair being parallel to one another so as to form a retaining opening therebetween, said retaining openings extending parallel to one another along said base toward said opened portion such that each said retaining opening has a closed end closed by said upstanding side and an opened end at said opened portion of said upstanding side;

a respective sliding block located in each respective said retaining opening;

a respective spring located in each respective said retaining opening between a respective said sliding block and a respective said closed end for urging said respective sliding block toward a respective said opened end;

a shaft having a pin hole therethrough;

a pin mounted in said opened portion of said upstanding side by said terminal ends of said upstanding side, said pin being received in said pin hole of said shaft for mounting said shaft for pivoting movement in said opened portion and such that said sliding blocks are urged directly against said shaft in a direction perpendicular to said pin;

a hinge arm including one end having two spaced flanges with an aperture therein;

a mounting means for mounting said one end of said hinge arm to said shaft for pivoting movement therewith, said mounting neans including recesses in said shaft in which respective said spaced flanges are received such that said pin also passes through said apertures in said flanges; and a cover plate which is attached to said upstanding side to enclose side sliding blocks and said springs in said retaining openings.

2. A thin hinge as claimed in claim 1 wherein said upstanding side further includes a plurality of spaced posts and wherein said cover plate includes a plurality of spaced holes which receive a respective said post therein such that said posts are deformed to securely attach said cover plate to said bowl.

* * * * *